US009850788B2

(12) United States Patent
Otsubo et al.

(10) Patent No.: US 9,850,788 B2
(45) Date of Patent: Dec. 26, 2017

(54) VALVE TIMING CONTROLLER

(71) Applicants: DENSO CORPORATION, Kariya, Aichi-pref. (JP); NIPPON SOKEN, INC., Nishio, Aichi-pref. (JP)

(72) Inventors: Makoto Otsubo, Nishio (JP); Hiroki Takahashi, Kariya (JP)

(73) Assignees: DENSO CORPORATION, Kariya (JP); NIPPON SOKEN, INC., Nishio (JP)

( * ) Notice: Subject to any disclaimer, the term of this patent is extended or adjusted under 35 U.S.C. 154(b) by 149 days.

(21) Appl. No.: 15/083,641

(22) Filed: Mar. 29, 2016

(65) Prior Publication Data

US 2016/0290181 A1 Oct. 6, 2016

(30) Foreign Application Priority Data

Apr. 2, 2015 (JP) ..... 2015-76210

(51) Int. Cl.

| | |
|---|---|
| ***F01L 1/34*** | (2006.01) |
| ***F01L 1/352*** | (2006.01) |
| ***F01L 1/356*** | (2006.01) |
| *F01L 1/344* | (2006.01) |

(52) U.S. Cl.

CPC ..... *F01L 1/352* (2013.01); *F01L 1/356* (2013.01); *F01L 1/344* (2013.01)

(58) Field of Classification Search

CPC ..... F01L 1/344; F01L 1/352; F01L 1/356

USPC .... 123/90.15, 90.16, 90.17, 90.18; 464/1, 2, 464/160

See application file for complete search history.

(56) References Cited

U.S. PATENT DOCUMENTS

| | | | | |
|---|---|---|---|---|
| 8,127,729 | B2 * | 3/2012 | Takahashi | F01L 1/352 123/90.17 |
| 2007/0202981 | A1 | 8/2007 | Sugiura et al. | |
| 2009/0017952 | A1 | 1/2009 | Sugiura et al. | |
| 2010/0288216 | A1 | 11/2010 | Takahashi et al. | |

FOREIGN PATENT DOCUMENTS

| | | |
|---|---|---|
| JP | 2012-219680 | 11/2012 |

* cited by examiner

*Primary Examiner* — Ching Chang
(74) *Attorney, Agent, or Firm* — Nixon & Vanderhye PC

(57) ABSTRACT

A valve timing controller includes a driving rotor, a driven rotor, a planetary rotor, a planetary carrier, and an elastic component to produce a restoring force biasing the planetary rotor to an eccentric side such that the driving rotor is inclined to the driven rotor. The driving rotor has an inclination angle θ1 relative to the driven rotor in a first inclination state where the driving rotor is in contact with the driven rotor on both sides in the axial direction. The inclination angle θ1 is smaller than an inclination angle θ2 in a second inclination state where the driving rotor is in contact with the driven rotor on both sides in the radial direction, and is smaller than an inclination angle θ3 in a third inclination state where the driving rotor is in contact with the camshaft on both sides in the radial direction.

4 Claims, 8 Drawing Sheets

VALVE TIMING CONTROLLER

CROSS REFERENCE TO RELATED APPLICATION

This application is based on Japanese Patent Application No. 2015-76210 filed on Apr. 2, 2015, the disclosure of which is incorporated herein by reference in its entirety.

TECHNICAL FIELD

The present disclosure relates to a valve timing controller.

BACKGROUND

A valve timing controller controls a rotation phase between a driving rotor rotating with a crankshaft and a driven rotor rotating with a camshaft using planetary movement of a planetary rotor.

In JP 4360426 B (US 2009/0017952 A1), a driven rotor is connected coaxially with a camshaft which supports a driving rotor from a radially inner side (radial bearing), and supports the driving rotor on both sides in the axial direction (thrust bearing) and from a radially inner side (radial bearing). A planetary rotor is arranged eccentric to the driving rotor and the driven rotor, and is able to control the rotation phase by planetary movement due to a gear engagement state on the eccentric side from the radially inner side. The planetary movement of the planetary rotor can be realized smoothly by a planetary carrier that supports the driving rotor from a radially inner side (radial bearing). The control responsivity of the valve timing according to the rotation phase is improved in the valve timing controller.

Furthermore, the planetary rotor is biased to the eccentric side relative to the driving rotor and the driven rotor by the restoring force of an elastic component interposed between the planetary carrier and the planetary rotor. Thereby, the rattling noise is controlled at the engagement part of the planetary rotor relative to the driving rotor and the driven rotor.

SUMMARY

It is an object of the present disclosure to provide a valve timing controller in which abnormal noise can be reduced.

According to an aspect of the present disclosure, a valve timing controller that controls valve timing of a valve opened and closed by a camshaft using a torque transferred from a crankshaft for an internal-combustion engine includes a driving rotor, a driven rotor, a planetary rotor, a planetary carrier, and an elastic component. The driving rotor rotates with the crankshaft in a state where the driving rotor is supported by the camshaft from an inner side in a radial direction. The driven rotor rotates with the camshaft in a state where the driven rotor supports the driving rotor on both sides in an axial direction and where the driven rotor supports the driving rotor from an inner side in a radial direction. The driven rotor is connected coaxially with the camshaft. The planetary rotor is arranged eccentric relative to the driving rotor and the driven rotor, and controls a rotation phase between the driving rotor and the driven rotor by carrying out planetary movement under a gear engagement state in which the planetary rotor is engaged with the driving rotor and the driven rotor from an inner side in the radial direction on an eccentric side. The planetary carrier causes the planetary movement of the planetary rotor under a state where the driving rotor is supported from the inner side in the radial direction, and where the planetary rotor is supported from the inner side in the radial direction. The elastic component is interposed between the planetary rotor and the planetary carrier to produce a restoring force biasing the planetary rotor to the eccentric side such that the driving rotor is inclined to the driven rotor. The driving rotor has an inclination angle θ1 relative to the driven rotor in a first inclination state where the driving rotor is in contact with the driven rotor on both sides in the axial direction. The driving rotor has an inclination angle θ2 relative to the driven rotor in a second inclination state where the driving rotor is in contact with the driven rotor on both sides in the radial direction. The driving rotor has an inclination angle θ3 relative to the driven rotor in a third inclination state where the driving rotor is in contact with the camshaft on both sides in the radial direction. A relation of $\theta 1<\theta 2$ and a relation of $\theta 1<\theta 3$ are satisfied.

Accordingly, the inclination angle θ1 in the first inclination state is smaller than the inclination angle θ2 in the second inclination state, and is smaller than the inclination angle θ3 in the third inclination state, while the driving rotor is inclined to the driven rotor by the restoring force of the elastic component. Therefore, among the three kinds of assumed inclination states, the first inclination state is realized in fact, and the second inclination state and the third inclination state can be restricted. This means that the driving rotor can maintain, against the restoring force of the elastic component, to be in contact with the driven rotor on the both sides in the axial direction, prior to the contact with the driven rotor and the camshaft in the radial direction. Therefore, the driving rotor can be restricted from moving to the driven rotor in the axial direction, such that noise caused by a collision of the rotors can be controlled.

In other words, noise caused when the driving rotor collides with the driven rotor can be restricted, while abnormal noise caused by a backlash can be restricted by setting the position of the engagement part of the planetary rotor relative to the driving rotor and the driven rotor.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
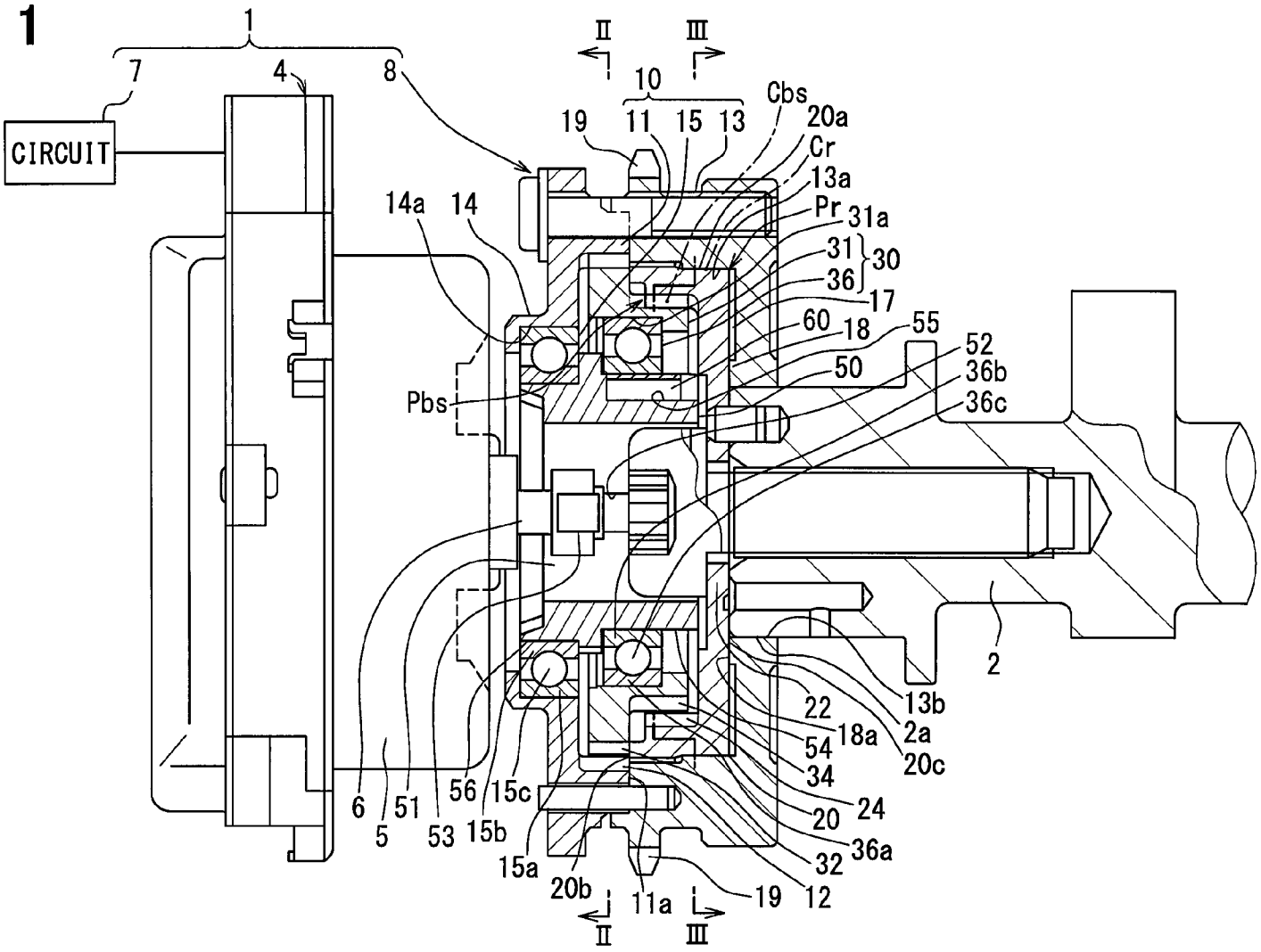
FIG. 1 is a view illustrating a valve timing controller according to an embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

As shown in FIG. 1, a valve timing controller 1 according to an embodiment is attached to a transfer system which transmits crank torque to a camshaft 2 from a crankshaft (not shown) in an internal-combustion engine of a vehicle. The camshaft 2 opens and closes an intake valve (not shown) using transfer of crank torque as a valve of the internal-combustion engine. The valve timing controller 1 controls the valve timing of the intake valve.

Figure 2:
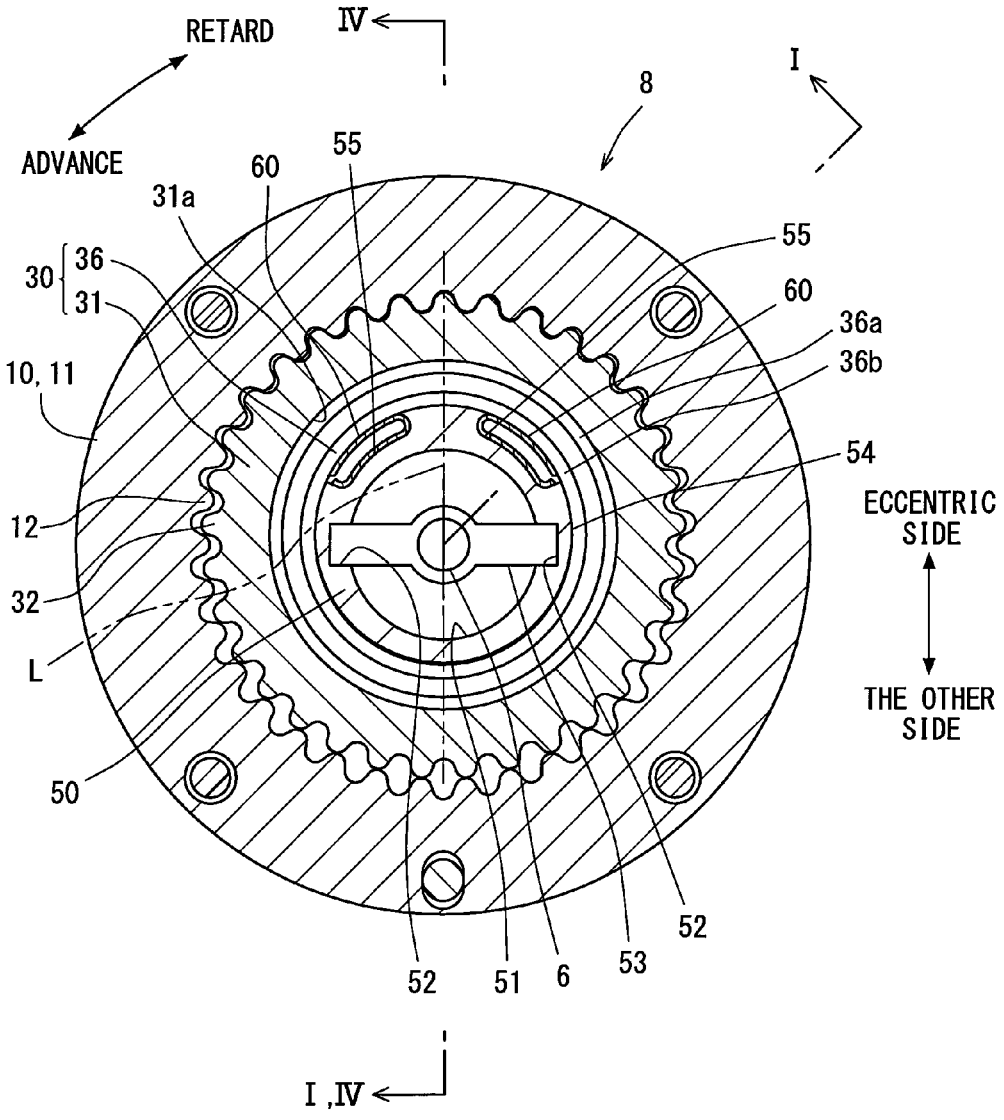
FIG. 2 is a sectional view taken along a line II-II of FIG. 1.
Figure 3:
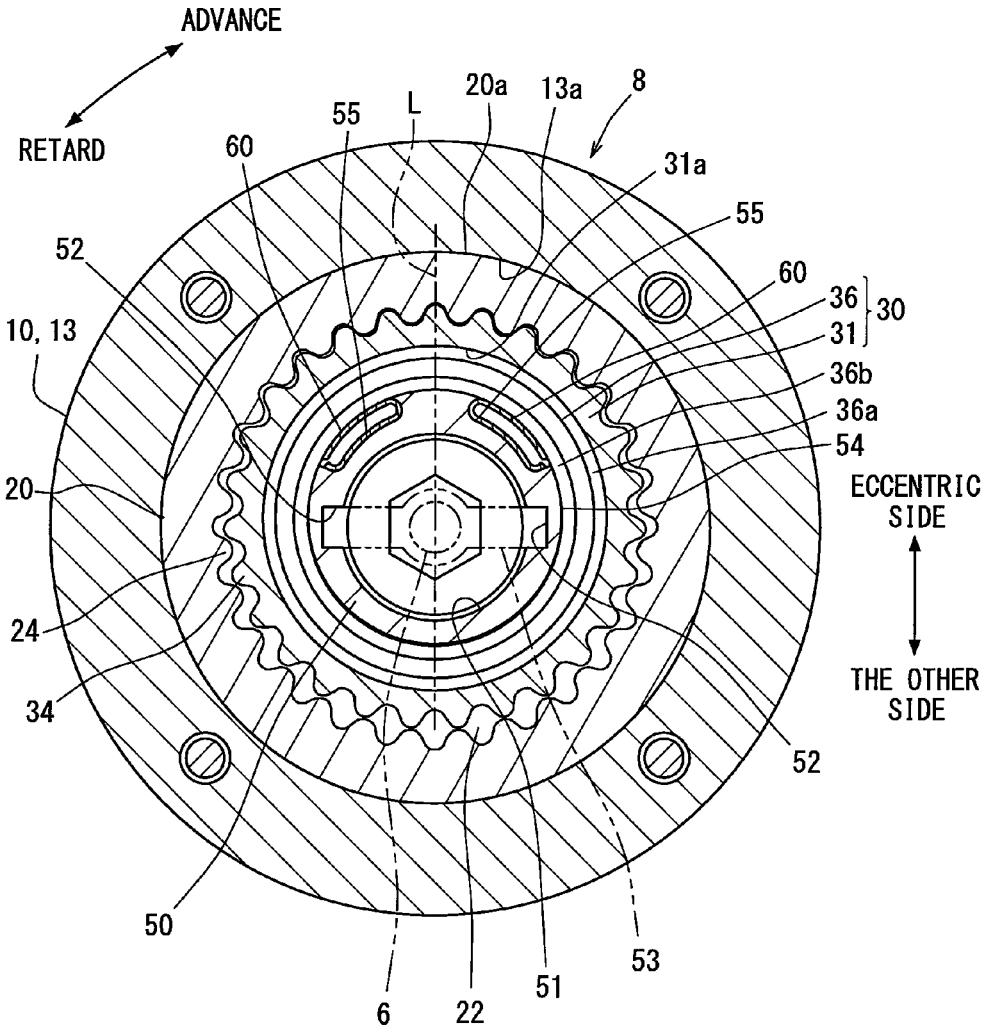
FIG. 3 is a sectional view taken along a line of FIG. 1.

As shown in FIGS. 1-3, the valve timing controller 1 includes an actuator 4, a circuit unit 7, and a phase adjustment unit 8.

As shown in FIG. 1 that includes a sectional view taken along a line I-I of FIG. 2, the actuator 4 is an electric motor such as brushless motor, and has a housing body 5 and a control shaft 6. The housing body 5 is fixed to a fix portion of the internal-combustion engine, and supports the control shaft 6 in a rotatable state. The circuit unit 7 includes a drive driver and a microcomputer for control, and is arranged outside and/or inside the housing body 5. The circuit unit 7 is electrically connected to the actuator 4, and controls power supply to the actuator 4 to rotate the control shaft 6.

As shown in FIGS. 1-3, the phase adjustment unit 8 includes a driving rotor 10, a driven rotor 20, a planetary rotor 30, a planetary carrier 50, and an elastic component 60.

Figure 4:
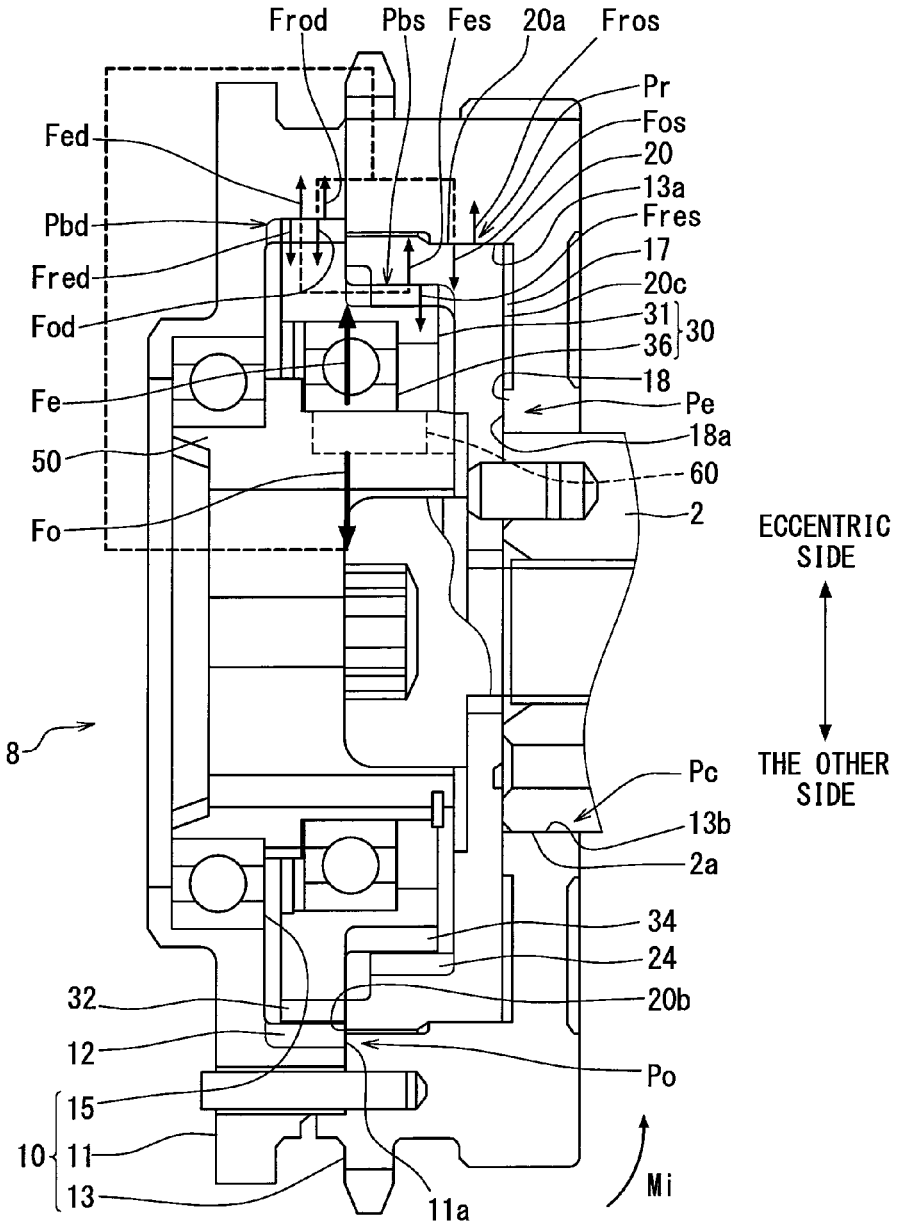
FIG. 4 is an enlarged sectional view taken along a line IV-IV of FIG. 2.

The driving rotor 10 is made of metal, and has a hollow shape as a whole. The driven rotor 20, the planetary rotor 30, the planetary carrier 50, and the elastic component 60 of the phase adjustment unit 8 are held inside the driving rotor 10. As shown in FIGS. 1, 2, and 4, the driving rotor 10 includes a sun gear 11, a sprocket 13, and a drive bearing 15.

The sun gear 11 has a cylindrical shape with a projection. The sprocket 13 has a based cylindrical shape. The sun gear 11 is rotatable integrally with the sprocket 13. The sun gear 11 and the sprocket 13 are tightened with each other. The sun gear 11 has a drive side internal-gear part 12 with a tip circle on the radially inner side of a root circle. The drive side internal-gear part 12 is defined on the large diameter side inner circumference of the circumference wall part. As shown in FIG. 1, the sun gear 11 has a journal part 14 on the small diameter side inner circumference of the circumference wall part. The journal part 14 is located opposite from the camshaft 2 through the drive side internal-gear part 12 in the axial direction.

The sprocket 13 is arranged coaxially with the camshaft 2. The camshaft 2 is made of metal, and has a cylindrical shape. The sprocket 13 is located on the radially outer side of the camshaft 2. In other words, a radial bearing is defined between the sprocket 13 and the camshaft 2. An inner circumference surface 13*b* of a bottom wall part of the sprocket 13 is slidably fitted to the outer circumference surface 2*a* of the camshaft 2, such that a radial bearing is defined. Specifically, the inner circumference surface 13*b* is supported by the camshaft 2 from the inner side in the radial direction. In this state, the camshaft 2 extends from the radially inner side of the sprocket 13 in the axial direction away from the sun gear 11. Moreover, the sprocket 13 has a projection part 18 projected toward the sun gear 11 in the axial direction. The projection part 18 has a circular shape continuing in the circumferential direction. The projection part 18 is defined on the inner bottom surface of the bottom wall part of the sprocket 13. The projection part 18 is located on the radially inner side of the large diameter side end surface 11*a* of the circumference wall part of the sun gear 11.

The sprocket 13 has plural sprocket teeth 19 on the outer circumference surface of the circumference wall part. The sprocket teeth 19 are projected outward in the radial direction, and are arranged in the circumferential direction with a regular interval. A timing chain (not shown) is disposed between the sprocket teeth 19 of the sprocket 13 and plural sprocket teeth of the crankshaft, such that the sprocket 13 and the crankshaft are engaged with each other. A crank torque outputted from the crankshaft is transmitted to the sprocket 13 through the timing chain. As the result, the driving rotor 10 is rotated with the crankshaft in a fixed direction (counterclockwise in FIG. 2, clockwise in FIG. 3) while the driving rotor 10 is supported by the camshaft 2 in the radial direction.

The drive bearing 15 is coaxially arranged on the radially inner side of the journal part 14. The drive bearing 15 has a circular shape and is made of metal. The drive bearing 15 is a single sequence type radial bearing in which one row of spherical rolling elements 15*c* are arranged between the outer wheel 15*a* and the inner wheel 15*b*. The outer wheel 15*a* is coaxially press-fitted to the inner circumference surface 14*a* of the journal part 14, such that the sun gear 11 and the drive bearing 15 can rotate integrally with each other.

As shown in FIGS. 1 and 3, the driven rotor 20 having the based cylindrical shape made of metal is coaxially arranged on the radially inner side of the sprocket 13. In other words, the driven rotor 20 supports the driving rotor 10 in the radial direction as a radial bearing. Of the circumference wall part of the driven rotor 20 shown in FIG. 1, the bottom wall side outer circumference surface 20*a* is slidably fitted with the bottom wall side inner circumference surface 13*a* of the circumference wall part of the sprocket 13, such that the bottom wall side outer circumference surface 20*a* supports the driving rotor 10 from the radially inner side as a radial bearing.

The driven rotor 20 is supported between the sun gear 11 and the sprocket 13 in the axial direction, and supports the driving rotor 10 on both sides in the axial direction as a thrust bearing. An opening end surface 20*b* of the circumference wall part of the driven rotor 20 is in contact with the large diameter side end surface 11*a* of the circumference wall part of the sun gear 11, and supports the driving rotor 10 from a side adjacent to the camshaft 2 in the axial direction as a thrust bearing. On the other hand, an outer end surface 20*c* of the bottom wall part of the driven rotor 20 is in contact with the tip end surface 18*a* of the projection part 18 of the bottom wall part of the sprocket 13, and supports the driving rotor 10 from the opposite side of the camshaft 2 in the axial direction as a thrust bearing.

As shown in FIGS. 1 and 3, the driven rotor 20 has a connection part 22 at the central part of the bottom wall part to be connected with the camshaft 2 coaxially. The driven rotor 20 rotating in the same direction (clockwise in FIG. 3) can rotate relative to the driving rotor 10 under the state where the driven rotor 20 supports the driving rotor 10 on the both sides in the axial direction (thrust bearing) and from the inner side in the radial direction (radial bearing).

The driven rotor 20 has a driven side internal-gear part 24 with a tip circle on the radially inner side of a root circle. The driven side internal-gear part 24 is defined on the opening side inner circumference surface of the circumference wall part. The driven side internal-gear part 24 is arranged offset relative to the drive side internal-gear part 12 toward the camshaft 2 in the axial direction, not to overlap in the radial direction. The inside diameter of the driven side internal-gear part 24 is set smaller than the inside diameter of the drive side internal-gear part 12. The number of teeth of the driven side internal-gear part 24 is set less than the number of teeth of the drive side internal-gear part 12.

As shown in FIGS. 1-4, the planetary rotor (gear rotor) 30 having a disk shape, as a whole, made of metal is arranged eccentric to the rotors 10 and 20. The planetary rotor 30 has a planetary gear 31 and a planetary bearing 36.

As shown in FIGS. 1-3, the planetary gear 31 is arranged to extend from the radially inner side of the driven rotor 20 to the radially inner side of the drive side internal-gear part 12. The planetary gear 31 is made of metal, and has a ring shape with a projection. The planetary gear 31 has the external-gear part 32, 34 with a tip circle on the radially outer side of a root circle, around the outer circumference surface of the circumference wall part. The drive side external-gear part 32 is engaged with the drive side internal-gear part 12 from the radially inner side on the eccentric side where the planetary gear 31 is eccentric to the rotors 10 and 20. The driven side external-gear part 34 is formed at a position not overlapping with the drive side external-gear part 32 in the radial direction. Specifically, the driven side external-gear part 34 is positioned to shift toward the camshaft 2 in the axial direction, relative to the drive side external-gear part 32. The outer diameter of the driven side external-gear part 34 is different from that of the drive side external-gear part 32, and is smaller than the outer diameter of the drive side external-gear part 32. The number of teeth of the driven side external-gear part 34 is set less than the number of teeth of the drive side external-gear part 32. The driven side external-gear part 34 is engaged with the driven side internal-gear part 24 from the radially inner side on the eccentric side.

As shown in FIG. 1, compared with the center Cr of the radial bearing part Pr in the axial direction where the sprocket 13 is supported by the driven rotor 20, the center Cbs of the engagement part Pbs between the driven side external-gear part 34 and the driven side internal-gear part 24 in the axial direction is shifted away from the camshaft 2 in the axial direction. The axial center Cbs of the engagement part Pbs represents a center of an area where the driven side external-gear part 34 and the driven side internal-gear part 24 are actually engaged and overlapped with each other in the axial direction. The axial center Cr of the radial bearing part Pr represents a center of an area where the circumference surfaces 13*a*, 20*a* of the sprocket 13 and the driven rotor 20 are slidingly overlapped with each other actually in the axial direction.

As shown in FIGS. 1-3, the planetary bearing 36 is arranged to extend from the radially inner side of the drive side external-gear part 32 to the radially inner side of the driven side external-gear part 34. The planetary bearing 36 is made of metal, and has a circular shape. The planetary bearing 36 is a single sequence type radial bearing in which one row of spherical rolling elements 36*c* is interposed between the outer wheel 36*a* and the inner wheel 36*b*. The outer wheel 36*a* is coaxially press-fitted to the inner circumference surface 31*a* of the planetary gear 31, such that the planetary gear 31 and the planetary bearing 36 are integrally able to have planetary movement.

The planetary carrier 50 is made of metal, and has a partially-eccentric cylindrical shape. The planetary carrier 50 is arranged to extend from the radially inner side of the planetary rotor 30 to the radially inner side of the journal part 14. The planetary carrier 50 has an input unit 51 having a cylindrical surface coaxial with the rotors 10 and 20 and the control shaft 6. The input unit 51 is formed on the inner circumference surface of the circumference wall part. The input unit 51 has a connection slot 52 fitted to the joint 53, and the control shaft 6 is connected with the planetary carrier 50 through the joint 53, such that the planetary carrier 50 can rotate integrally with the control shaft 6.

As shown in FIG. 1, the planetary carrier 50 has a coaxial part 56 on the outer circumference surface of the circumference wall part. The coaxial part 56 has a cylindrical surface coaxial with the rotors 10 and 20. The coaxial part 56 is coaxially fitted to the inner wheel 15*b* of the drive bearing 15 from the outer side, and supports the driving rotor 10 from the radially inner side (radial bearing). Under this situation, the planetary carrier 50 can rotate relative to the rotors 10 and 20, while coaxially rotating.

As shown in FIGS. 1-3, the planetary carrier 50 has an eccentric part 54 on the outer circumference surface of the circumference wall part. The eccentric part 54 has a cylindrical surface eccentric to the rotors 10 and 20. The eccentric part 54 is coaxially fitted to the inner wheel 36*b* of the planetary bearing 36 from the outer side, and supports the planetary rotor 30 from the radially inner side (radial bearing). Under this bearing state, the planetary carrier 50 causes the planetary movement of the planetary rotor 30 according to the relative rotation to the driving rotor 10. At this time, the planetary rotor 30 rotating in the own circumferential direction revolves in the rotating direction of the planetary carrier 50 under a gear engagement state where engaged with the rotors 10 and 20 on the eccentric side.

One metal elastic component 60 is received in a concave portion 55 opened at two positions in the circumferential direction of the eccentric part 54. The elastic component 60 is a board spring having approximately U-shape in the cross-section. The elastic component 60 is interposed between the inner wheel 36*b* of the planetary bearing 36 of the planetary rotor 30 and the concave portion 55. The elastic component 60 is compressed in the radial direction of the planetary rotor 30, and is elastically deformed, such that the restoring force is generated.

As shown in FIGS. 2 and 3, a base line L is assumed to extend straight along with the radial direction in which the planetary rotor 30 is eccentric to the rotors 10 and 20. The elastic component 60 is arranged at symmetry positions about the base line L in an arbitrary range in the axial direction. As a result, as shown in FIGS. 2 and 4, the total of the restoring forces of the elastic components 60 generates a radial force Fe acting on the planetary rotor 30 on the eccentric side along the base line L, and a radial force Fo of acting on the planetary carrier 50 on the other side opposite from the eccentric side (hereafter referred to "the other side") along the base line L. In this way, while each elastic component 60 is held in the concave portion 55 by the radial force Fo on the other side, the planetary rotor 30 is biased by the radial force Fe on the eccentric side, such that the engagement state of the rotors 10 and 20 can be maintained on the eccentric side.

The phase adjustment unit 8 controls the rotation phase between the driving rotor 10 and the driven rotor 20 according to the rotation state of the control shaft 6, such that the valve timing can be controlled suitably for the operation situation of the internal-combustion engine.

Specifically, when the planetary carrier 50 does not carry out relative rotation to the rotor 10, the control shaft 6 rotates at the same speed as the driving rotor 10, and the planetary rotor 30 does not carry out planetary movement and rotates with the rotors 10 and 20. As a result, the rotation phase is substantially the same, and the valve timing is maintained.

When the planetary carrier 50 carries out relative rotation in the retard direction to the rotor 10, the control shaft 6 rotates at a low speed or in an opposite direction to the driving rotor 10, and the driven rotor 20 will carry out relative rotation in the retard direction to the driving rotor 10 by planetary movement of the planetary rotor 30. As a result, the rotation phase is retarded to retard the valve timing.

When the planetary carrier 50 carries out relative rotation in the advance direction to the rotor 10, the control shaft 6 rotates at a speed higher than the driving rotor 10, and the driven rotor 20 will carry out relative rotation in the advance direction to the driving rotor 10 by planetary movement of the planetary rotor 30. As a result, the rotation phase is advanced to advance the valve timing.

Hereafter, correlation of the radial forces generated in the phase adjustment unit 8 is explained based on FIG. 4.

The radial force Fe acting to the eccentric side by the elastic component 60 is distributed to a radial force Fed in which the planetary rotor 30 presses the driving rotor 10 to the eccentric side, and a radial force Fes in which the planetary rotor 30 presses the driven rotor 20 to the eccentric side. The radial force Fed acts on the driving rotor 10 from the planetary rotor 30 through the engagement part Pbd of the gear parts 12 and 32. The radial force Fes acts on the driven rotor 20 from the planetary rotor 30 through the engagement part Pbs of the gear parts 24 and 34.

The radial force Fred in which the driving rotor 10 presses the planetary rotor 30 to the other side is generated as a reaction of the radial force Fed. The radial force Fres in which the driven rotor 20 presses the planetary rotor 30 to the other side is generated as a reaction of the radial force Fes. The radial force Fred acts on the planetary rotor 30 from the driving rotor 10 through the engagement part Pbd of the gear parts 12 and 32. The radial force Fres acts on the planetary rotor 30 from the driven rotor 20 through the engagement part Pbs of the gear parts 24 and 34.

The radial force Fo acting to the other side by the elastic component 60 acts on the driving rotor 10 to the other side through the planetary carrier 50. As the result, the radial force Fo is distributed to a radial force Fod in which the driving rotor 10 presses the planetary rotor 30 to the other side, and a radial force Fos in which the driving rotor 10 presses the driven rotor 20 to the other side. The radial force Fod acts on the planetary rotor 30 from the driving rotor 10 through the engagement part Pbd of the gear parts 12 and 32. The radial force Fos acts on the driven rotor 20 from the driving rotor 10 through the radial bearing part Pr of the circumference surfaces 13*a* and 20*a*.

The radial force Frod in which the planetary rotor 30 presses the driving rotor 10 is generated as a reaction of the radial force Fod. The radial force Fros in which the driven rotor 20 presses the driving rotor 10 to the eccentric side is generated as a reaction of the radial force Fos. The radial force Frod acts on the driving rotor 10 from the planetary rotor 30 through the engagement part Pbd of the gear parts 12 and 32. The radial force Fros acts on the driving rotor 10 from the driven rotor 20 through the radial bearing part Pr of the circumference surfaces 13*a* and 20*a*.

The radial force Fes, Fos acting on the driven rotor 20 is supported with the camshaft 2 connected with the rotor 20. Moreover, the radial force Fed, Frod and the radial force Fred, Fod are cancelled by each other, respectively acting on the driving rotor 10 and the planetary rotor 30 through the engagement part of the gear parts 12 and 32. Furthermore, the axial center Cbs of the engagement part Pbs and the axial center Cr of the radial bearing part Pr (refer to FIG. 1) are shifted from each other in the axial direction, to which the radial force Fres and the radial force Fros act respectively. Thus, the radial force Fres and the radial force Fros generate an inclination moment Mi to make the driving rotor 10 inclined counterclockwise of FIG. 4 to the driven rotor 20.

The driving rotor 10 is inclined by the inclination moment Mi, and the end surface 11*a* of the driving rotor 10 is in contact with the end surface 20*b* of the driven rotor 20 on the other side. Therefore, the driving rotor 10 is supported by the driven rotor 20 from the side adjacent to the camshaft 2 in the axial direction (thrust bearing), and the thrust bearing part Po can be defined. On the eccentric side, the end surface 18*a* of the driving rotor 10 is in contact with the end surface 20*c* of the driven rotor 20, and the driving rotor 10 is supported by the driven rotor 20 from the opposite side of the camshaft 2 in the axial direction (thrust bearing), such that the thrust bearing part Pe can be defined.

That is, the thrust bearing part Pe of the driving rotor 10 by the driven rotor 20 on the eccentric side is defined by the contact between the end surface 18*a* of the projection part 18 projected in the axial direction from the driving rotor 10 and the driven rotor 20. As a result, the thrust bearing part Pe of the driving rotor 10 by the driven rotor 20 on the eccentric side is located on the radially inner side of the thrust bearing part Po of the driving rotor 10 by the driven rotor 20 on the other side, according to the spatial relationship of the end surfaces 11*a* and 18*a*.

Figure 5:
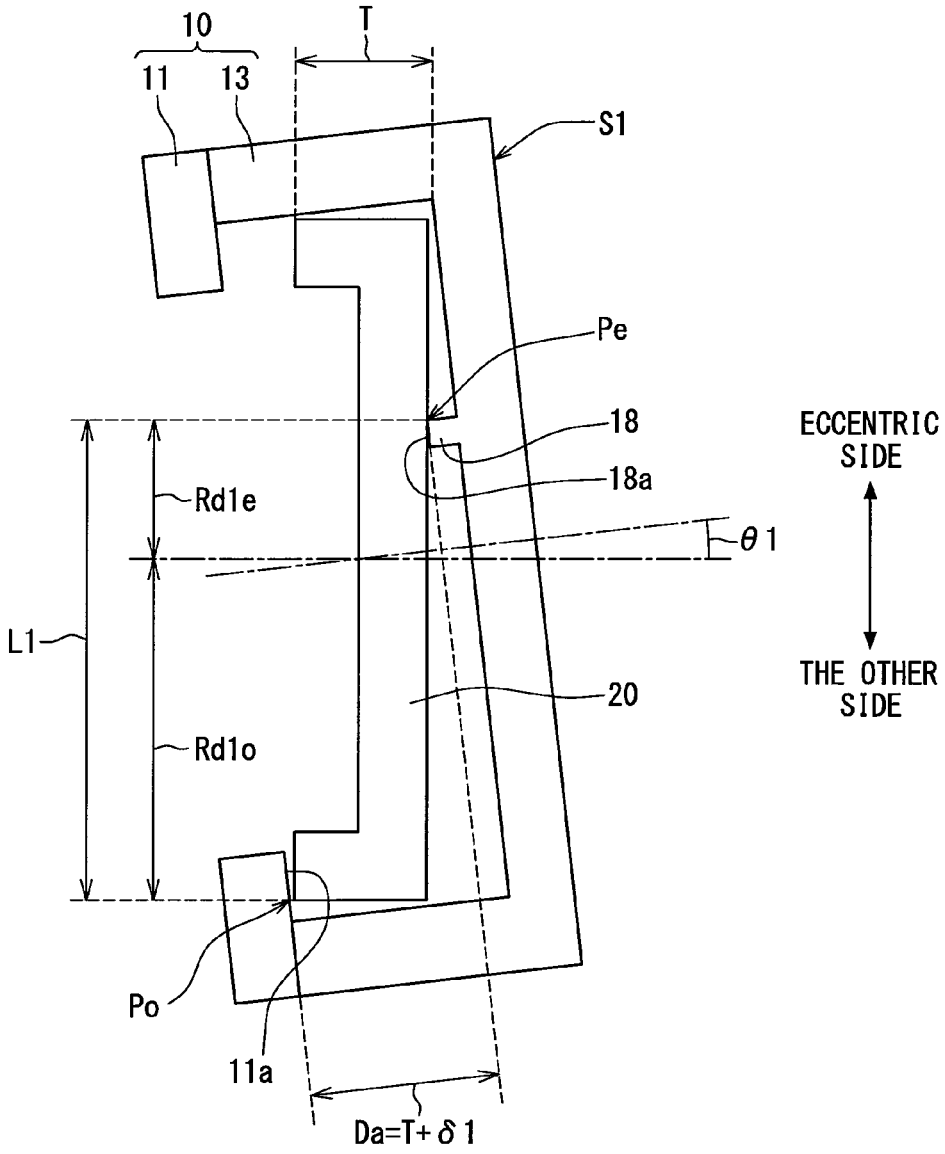
FIG. 5 is a diagram explaining a first inclination state assumed in a phase adjustment unit of FIG. 1.
Figure 6:
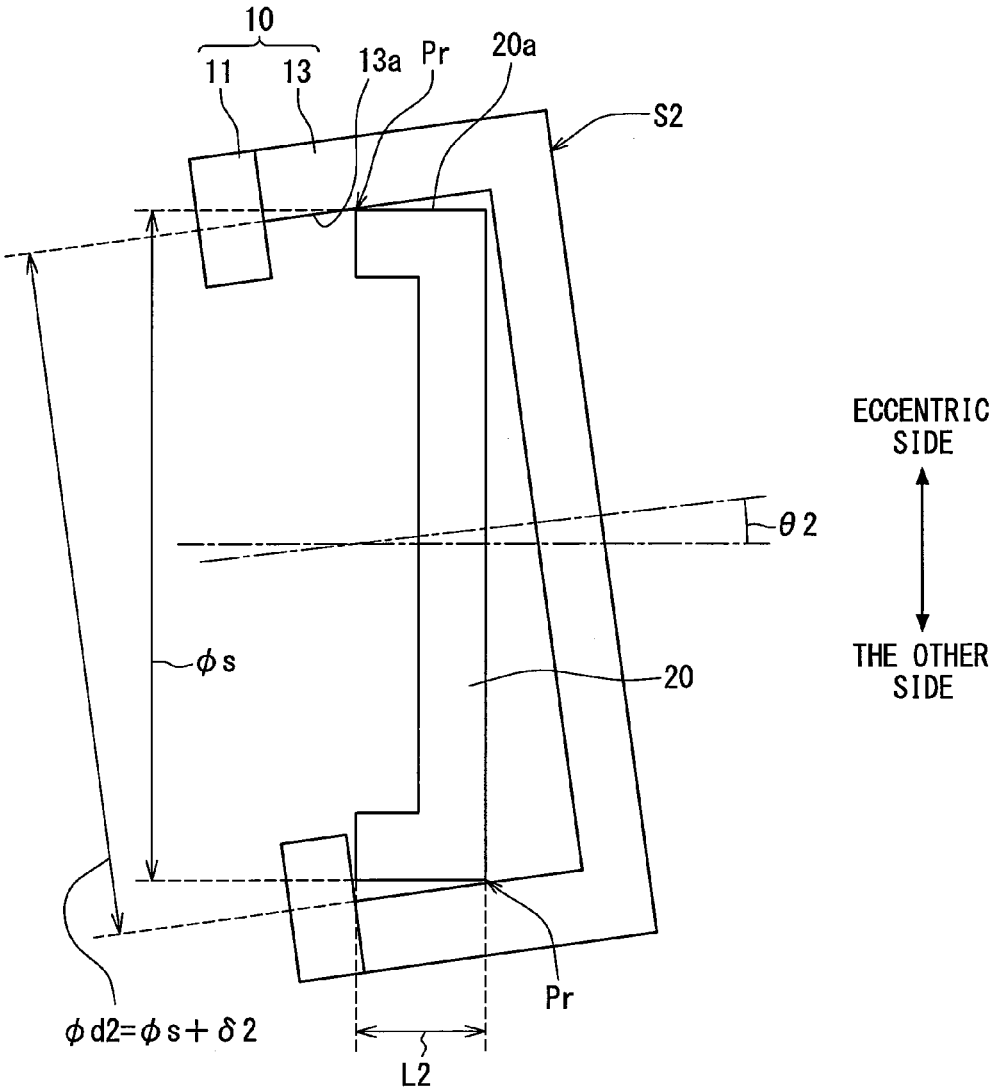
FIG. 6 is a diagram explaining a second inclination state assumed in the phase adjustment unit of FIG. 1.
Figure 7:
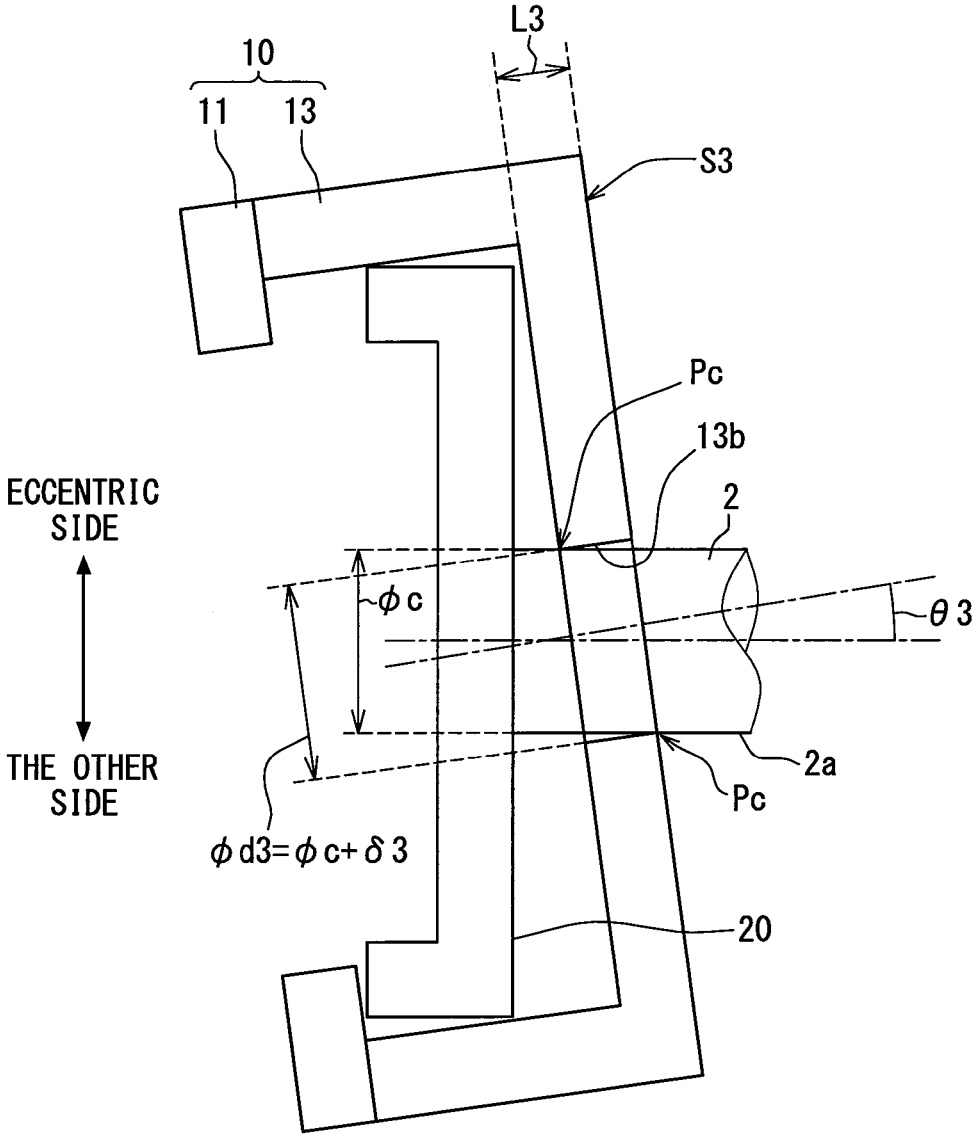
FIG. 7 is a diagram explaining a third inclination state assumed in the phase adjustment unit of FIG. 1.

In order to realize the inclination of the driving rotor 10 and the thrust bearing of the driven rotor 20, in this embodiment, three kinds of inclination states S1, S2, S3 of the rotor 10 are assumed as shown in FIGS. 5-7. An inclination angle θ1 is defined in the inclination state S1. An inclination angle θ2 is defined in the inclination state S2. An inclination angle θ3 is defined in the inclination state S3. Further, physical quantities δ1, δ2, δ3, L1, L2, L3 are defined for the inclination angles θ1, θ2, θ3.

As shown in FIG. 5, the driving rotor 10 in the first inclination state S1 is supposed, in which the end surfaces 11*a* and 18*a* are in contact with the driven rotor 20 on the both sides in the axial direction. Under this case, the inclination angle θ1 of the driving rotor 10 to the driven rotor 20 in the state S1 is defined. The inclination angle θ1 is approximately given by the following formula 1 using the physical quantity θ1 and L1, in which θ1 represents a difference (Da−T) in dimension between the axial distance Da and the axial thickness T. The axial distance Da is defined between the end surfaces 11*a*, 18*a* in the axial direction where the thrust bearing is carried out by the driven rotor 20 to the driving rotor 10. The driven rotor 20 has the axial thickness T in the axial direction between the end surfaces 11*a*, 18*a*. L1 represents a radial distance between the thrust bearing part Pe of the driving rotor 10 by the driven rotor 20 on the eccentric side and the thrust bearing part Po of the driving rotor 10 by the driven rotor 20 on the other side, in the radial direction. That is, L1 is defined as the sum (Rd1*e*+Rd1*o*) of the radius Rd1*e* of the thrust bearing part Pe on the eccentric side and the radius Rd1*o* of the thrust bearing part Po on the other side.

$$\theta 1 \approx \arctan(\delta 1/L1) \quad \text{(formula 1)}$$

As shown in FIG. 6, the driving rotor 10 in the second inclination state S2 is supposed, in which the inner circumference surface 13*a* is in contact with the driven rotor 20 on the both sides in the radial direction. Under this case, the inclination angle θ2 of the driving rotor 10 to the driven rotor 20 in the state S2 is defined. The inclination angle θ2 is approximately given by the following formula 2 using the physical quantity δ2 and L2, in which δ2 represents a difference (φd2−φs) in dimension between the diameter φd2 and the diameter φs. The inner circumference surface 13*a* has the diameter φd2 in which the radial bearing is carried out by the driven rotor 20 to the driving rotor 10. The outer circumference surface 20*a* has the diameter φs in which the radial bearing is carried out between the driving rotor 10 and the driven rotor 20. L2 represents a bearing width of the radial bearing part Pr by the driven rotor 20 to the driving rotor 10 in the axial direction. That is, L2 is defined as an axial length of the radial bearing part Pr of the circumference surfaces 13*a*, 20*a* overlapping with each other.

$$\theta 2 \approx \arctan(\delta 2/L2) \quad \text{(formula 2)}$$

As shown in FIG. 7, the driving rotor 10 in the third inclination state S3 is supposed, in which the inner circumference surface 13*b* is in contact with the camshaft 2 on the both sides in the radial direction. Under this case, the inclination angle θ3 of the driving rotor 10 to the driven rotor 20 in the state S3 is defined. The inclination angle θ3 is approximately given by the following formula 3 using the physical quantity δ3 and L3, in which 83 represents a difference (φd3−φc) in dimension between the diameter φd3 and the diameter φc. The inner circumference surface 13*b* has the diameter φd3 in which the radial bearing is carried out by the camshaft 2 to the driving rotor 10. The outer circumference surface 2*a* has the diameter φc in which the radial bearing is carried out between the driving rotor 10 and the camshaft 2. L3 represents a bearing width of the radial bearing part Pc (refer to FIG. 4 and FIG. 7) by the camshaft 2 to the driving rotor 10 in the axial direction. That is, L3 is defined as an axial length of the radial bearing part Pc of the circumference surfaces 13*b*, 2*a* overlapping with each other.

$$\theta 3 \approx \arctan(\delta 3/L3) \quad \text{(formula 3)}$$

Under the above definitions, in this embodiment, the following formulas 4 and 5 are satisfied to restrict the second inclination state S2 and the third inclination state S3 while realizing the first inclination state S1. Therefore, the driving rotor 10 can maintain to be in contact with the driven rotor 20 on the both sides in the axial direction, prior to the contact with the driven rotor 20 and the camshaft 2 on the both sides in the radial direction. In this embodiment, the structure of the phase adjustment unit 8 is designed to satisfy both the formulas 6 and 7 defined from the formulas 4 and 5 and the formulas 1-3.

$$\theta 1 < \theta 2 \quad \text{(formula 4)}$$

$$\theta 1 < \theta 3 \quad \text{(formula 5)}$$

$$\delta 1/L1 < \delta 2/L2 \quad \text{(formula 6)}$$

$$\delta 1/L1 < \delta 3/L3 \quad \text{(formula 7)}$$

The action and effect of the valve timing controller 1 are explained below.

The formulas 4 and 5 are satisfied in the valve timing controller 1. That is, the inclination angle θ1 in the first inclination state S1 is smaller than the inclination angle θ2 in the second inclination state S2 and is smaller than the inclination angle θ3 in the third inclination state S3, when the driving rotor 10 is inclined to the driven rotor 20 by the restoring force of the elastic component 60. Among the three kinds of assumed inclination states S1, S2, S3, the first inclination state S1 is realized in fact, and the second inclination state S2 and the third inclination state S3 are restricted.

This means that the driving rotor 10 can be maintained to be in contact with the driven rotor 20 on the both sides in the axial direction prior to the contact with the driven rotor 20 and the camshaft 2 on the both sides in the radial direction, against the restoring force of the elastic component 60. Therefore, the driving rotor 10 can be restricted from moving to the driven rotor 20 in the axial direction on the both sides, and abnormal noise caused by the collision of the rotors 10 and 20 can be controlled to provide more silence.

Moreover, the inclination angle θ1, θ2, θ3 can be approximately expressed by the formula 1, 2, 3, respectively, in the inclination state S1, S2, S3. The formulas 4 and 5 will also be satisfied when the formulas 6 and 7 are satisfied. That is, the inclination angle θ1 in the first inclination state S1 can be made smaller than any of the inclination angle θ2 in the second inclination state S2 and the inclination angle θ3 in the third inclination state S3 properly by adopting the structure satisfying the formulas 6 and 7. Therefore, since the driving rotor 10 can be restricted from moving in the axial direction on the both sides according to the valve timing controller 1 having the structure satisfying the formulas 6 and 7, the noise caused by the collision of the rotors 10 and 20 can be restricted with more reliability.

Furthermore, the axial center Cr of the radial bearing part Pr of the driving rotor 10 by the driven rotor 20 and the axial center Cbs of the engagement part Pbs of the planetary rotor 30 to the driven rotor 20 are shifted from each other in the axial direction. In this case, it becomes easy to generate the inclination moment Mi which makes the driving rotor 10 inclined to the driven rotor 20 by the restoring force of the elastic component 60. Accordingly, the driving rotor 10 inclined by the inclination moment Mi can be maintained certainly in the first inclination state S1 where the driving rotor 10 is in contact with the driven rotor 20 on the both sides in the axial direction. Therefore, the noise caused by the collision of the rotors 10 and 20 can be restricted with more reliability.

Furthermore, the thrust bearing part Pe of the driving rotor 10 by the driven rotor 20 on the eccentric side is located on the radially inner side of the thrust bearing part Po of the driving rotor 10 by the driven rotor 20 on the other side. The thrust bearing part Pe on the eccentric side is defined by the contact between the driven rotor 20 and the projection part 18 projected in the axial direction from the driving rotor 10. Thereby, since a space 17 (refer to FIG. 1 and FIG. 4) which permits the inclination of the driving rotor 10 can be formed on the radially outer side of the projection part 18, it is easier to realize the first inclination state S1 of the driving rotor 10 in contact with the driven rotor 20 on both sides in the axial direction. Therefore, the noise caused by the collision of the rotors 10 and 20 can be restricted with more reliability.

Modifications of the embodiment are described.

The axial center Cr of the radial bearing part Pr and the axial center Cbs of the engagement part Pbs may overlap with each other in the radial direction, while the formula 4 and the formula 5 are satisfied and the driving rotor 10 is inclined to the driven rotor 20 by the restoring force of the elastic component 60.

The thrust bearing part Pe on the eccentric side may be located on the radially outer side of the thrust bearing part Po on the other side opposite from the eccentric side, while the formula 4 and the formula 5 are satisfied and the driving rotor 10 is inclined to the driven rotor 20 by the restoring force of the elastic component 60.

Figure 8:
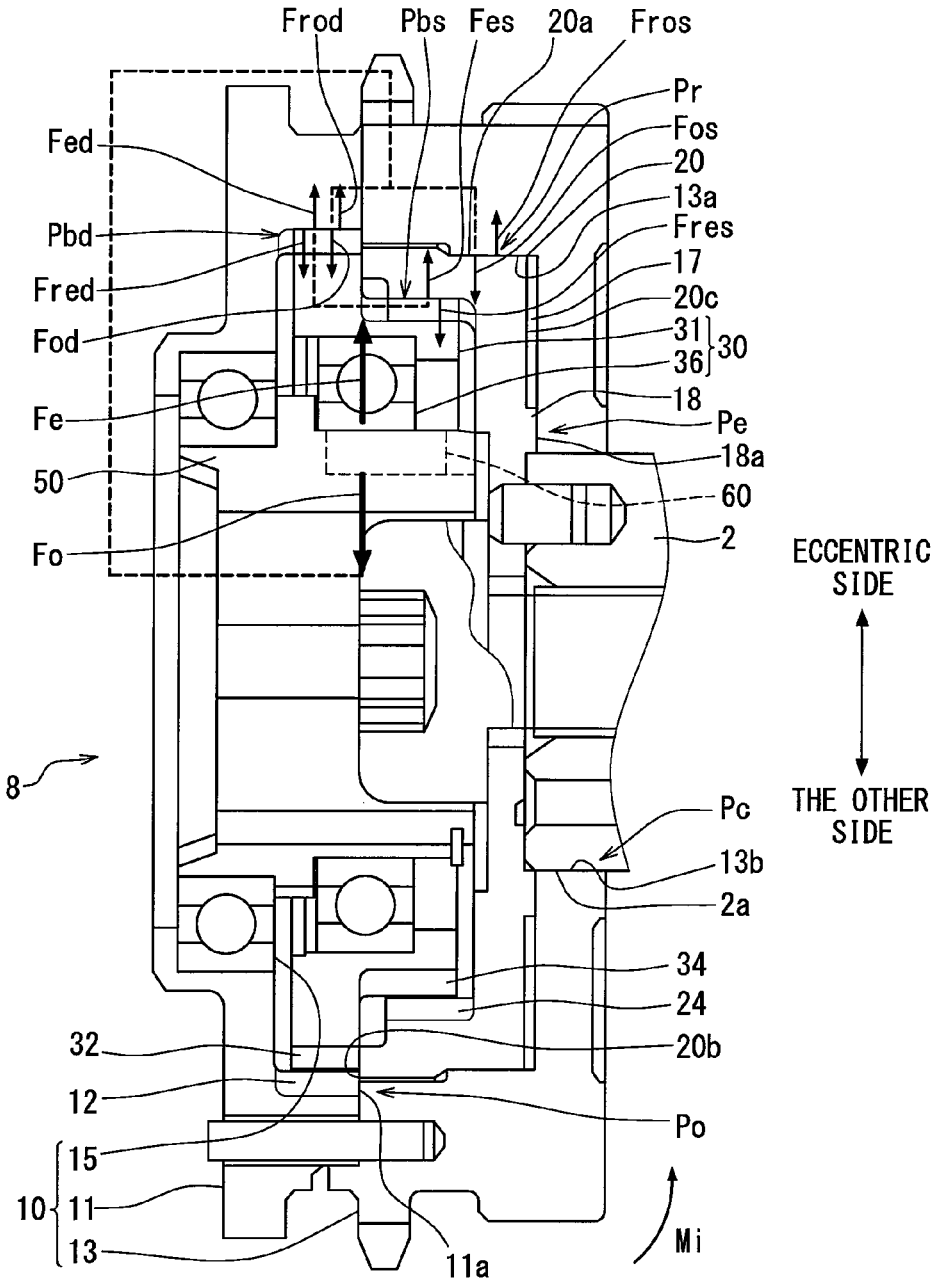
FIG. 8 is a sectional view illustrating a modification in the embodiment.

As shown in FIG. 8, the driven rotor 20 may have a projection part 18 projected from an outer end surface 20*c* of the bottom wall part toward the camshaft in the axial direction. The thrust bearing part Pe on the eccentric side may be defined by a tip end surface 18*a* of the projection part 18 in contact with the inner bottom surface of the bottom wall part of the sprocket 13.

One elastic component 60, or three or more elastic components 60 may be arranged at a proper position between the planetary rotor 30 and the planetary carrier 50 while the restoring force is generated to bias the planetary rotor 30 to the eccentric side.

The present disclosure may be applied to the other equipment which adjusts the valve timing of an exhaust valve or adjusts the valve timing of both of the intake valve and the exhaust valve.

Such changes and modifications are to be understood as being within the scope of the present disclosure as defined by the appended claims.

What is claimed is:

1. A valve timing controller that controls valve timing of a valve opened and closed by a camshaft using a torque transferred from a crankshaft for an internal-combustion engine, the valve timing controller comprising:

a driving rotor that rotates with the crankshaft in a state where the driving rotor is supported by the camshaft from an inner side in a radial direction;

a driven rotor that rotates with the camshaft in a state where the driven rotor supports the driving rotor on both sides in an axial direction and where the driven rotor supports the driving rotor from an inner side in the radial direction, the driven rotor being connected coaxially with the camshaft;

a planetary rotor arranged eccentric relative to the driving rotor and the driven rotor, the planetary rotor controlling a rotation phase between the driving rotor and the driven rotor by carrying out planetary movement under a gear engagement state in which the planetary rotor is engaged with the driving rotor and the driven rotor from an inner side in the radial direction on an eccentric side;

a planetary carrier that causes the planetary movement of the planetary rotor under a state where the driving rotor is supported from the inner side in the radial direction, and where the planetary rotor is supported from the inner side in the radial direction; and an elastic component interposed between the planetary rotor and the planetary carrier to produce a restoring force biasing the planetary rotor to the eccentric side such that the driving rotor is inclined to the driven rotor, wherein the driving rotor has an inclination angle $\theta 1$ relative to the driven rotor in a first inclination state where the driving rotor is in contact with the driven rotor on both sides in the axial direction, the driving rotor has an inclination angle $\theta 2$ relative to the driven rotor in a second inclination state where the driving rotor is in contact with the driven rotor on both sides in the radial direction, the driving rotor has an inclination angle $\theta 3$ relative to the driven rotor in a third inclination state where the driving rotor is in contact with the camshaft on both sides in the radial direction, and a relation of $\theta 1<\theta 2$ and a relation of $\theta 1<\theta 3$ are satisfied.

2. The valve timing controller according to claim 1, wherein a difference between an axial distance between both sides of the driving rotor supported by the driven rotor as a thrust bearing and an axial thickness of the driven rotor between the both sides in the axial direction is defined as $\delta 1$, a difference between a diameter of an inner circumference surface of the driving rotor where the driven rotor supports the driving rotor as a radial bearing and a diameter of an outer circumference surface of the driven rotor where the driven rotor supports the driving rotor as a radial bearing is defined as $\delta 2$, a difference between a diameter of an inner circumference surface of the driving rotor where the camshaft supports the driving rotor as a radial bearing and a diameter of an outer circumference surface of the camshaft where the camshaft supports the driving rotor as a radial bearing is defined as $\delta 3$, a radial distance between a thrust bearing part where the driven rotor supports the driving rotor on the eccentric side and a thrust bearing part where the driven rotor supports the driving rotor on the other side opposite from the eccentric side in the radial direction is defined as $L1$, the driven rotor supports the driving rotor in a radial bearing part with a bearing width of $L2$ in the axial direction, the camshaft supports the driving rotor in a radial bearing part with a bearing width of $L3$ in the axial direction, and a relation of $\delta 1/L1<\delta 2/L2$ and a relation of $\delta 1/L1<\delta 3/L3$ are satisfied.

3. The valve timing controller according to claim 1, wherein an axial center of a radial bearing part where the driven rotor supports the driving rotor and an axial center of an engagement part where the driven rotor is engaged with the planetary rotor are offset from each other in the axial direction.

4. The valve timing controller according to claim 1, wherein the driven rotor supports the driving rotor at a first thrust bearing part on the eccentric side, the driven rotor supports the driving rotor at a second thrust bearing part on the other side opposite from the eccentric side, one of the driving rotor and the drive rotor has a projection part projected in the axial direction, the first thrust bearing part is defined by the projection part in contact with the other of the driving rotor and the driven rotor, and the first thrust bearing part is located on a radially inner side of the second thrust bearing part.

* * * * *